United States Patent [19]

Bird et al.

[11] 4,234,406

[45] Nov. 18, 1980

[54] NONPLATING CATHODE AND METHOD FOR PRODUCING SAME

[75] Inventors: Richard A. Bird; Lowell W. Austin, both of Weirton, W. Va.

[73] Assignee: National Steel Corporation, Pittsburgh, Pa.

[21] Appl. No.: 27,450

[22] Filed: Apr. 5, 1979

Related U.S. Application Data

[62] Division of Ser. No. 921,674, Jul. 3, 1978, Pat. No. 4,160,703, which is a division of Ser. No. 830,834, Sep. 6, 1977, Pat. No. 4,145,267.

[51] Int. Cl.[3] ..... C25D 17/10

[52] U.S. Cl. ..... 204/292

[58] Field of Search ..... 204/290 R, 292, 280, 204/281

[56] References Cited

U.S. PATENT DOCUMENTS

| | | | |
|---|---|---|---|
| 2,044,415 | 6/1936 | Yates | 204/13 |
| 3,901,771 | 8/1975 | Froman | 204/206 |
| 3,988,216 | 10/1976 | Austin | 204/206 |
| 3,989,604 | 11/1976 | Austin | 204/206 |

*Primary Examiner*—T. M. Tufariello

*Attorney, Agent, or Firm*—Shanley, O'Neil & Baker

[57] ABSTRACT

A lead cathode which is immune to plating zinc on its surface when used in an electrolytic galvanizing solution.

1 Claim, No Drawings

NONPLATING CATHODE AND METHOD FOR PRODUCING SAME

This is a division of application Ser. No. 921,674, filed July 3, 1978 now U.S. Pat. No. 4,160,703, which is a division of application Ser. No. 830,834, filed Sept. 6, 1977 which is now U.S. Pat. No. 4,145,267, the entire disclosure of which is incorporated herein by reference.

BACKGROUND OF THE INVENTION

This invention relates to a method for producing a novel, nonplating cathode for use in electrolytic galvanizing processes and to the nonplating cathode so produced. As used herein, the term "nonplating" characterizes the immunity of the cathode against zinc plating on its surface during immersion in an electrolytic galvanizing bath.

In recent years, several important developments have occurred in the electrolytic galvanizing of steel strip, particularly in the area of forming galvanized strip material having a zinc coating on one side only. However, in common with all previously known methods for electrolytically galvanizing metal strip, the newer methods result in the production of a characteristic coating of zinc on cathodes immersed in the zinc ion containing electrolytic bath. After a period of time, this coating accumulates to such an extent that the operation of the system must be stopped and the zinc coating removed from the cathodes by various means, e.g., stripping. This of course decreases the efficiency of the operation, and thus increases its cost. While the ideal solution to this problem was known to lie in the use of a cathode which would be immune to the plating of zinc on its surface during such an operation, no such cathode was previously known to exist. In view of the present invention that is no longer the case, since a nonplating cathode has been produced according to the method which will be described hereinafter in detail.

SUMMARY OF THE INVENTION

In accordance with the broadest aspect of this invention, a nonplating cathode for use in an electrolytic galvanizing process is produced by placing the cathode, particularly a lead cathode, in an electrolytic bath containing zinc ions, electrolytically coating zinc on the surface of the cathode, and removing the coated zinc from the cathode. When used thereafter in an electrolytic galvanizing process, the cathode treated according to the above described method will be immune to plating zinc on its surface.

This method of treating the cathode may be conducted in situ, that is, within an electrolytic galvanizing bath for coating steel strip, or it may be employed in a separate facility and the cathode thereafter introduced into a system for producing electrolytically galvanized steel strip.

In a preferred embodiment, a lead cathode will be immersed in an electrolytic bath containing zinc sulfate and free sulfuric acid, and current applied for a sufficient period of time to form a light zinc coating on the surface of the cathode. The current is then shut off for a period of about one hour during which the zinc coating will dissolve in solution. At the end of this period a relatively low amount of current, e.g., about 4000 amps, is once again applied for one hour and hourly increased in increments of 2000 amps for a total of eight additional hours. Of course, the ultimate level of applied amperage is not critical—the ultimate amount being suggested by the size of the rectifier utilized in the electrolytic galvanizing process which employs the nonplating cathode of this invention in its operation.

DETAILED DESCRIPTION OF THE PREFERRED EMBODIMENTS

According to this invention, a nonplating cathode, particularly a nonplating lead cathode, is produced by immersing the lead cathode in an electrolytic solution containing zinc ions and free sulfuric acid, applying current to the cathode for a sufficient period of time, e.g., between about 10–15 minutes, so as to plate a light coating of zinc on the surface of the lead cathode and subsequently treating the cathode so as to remove the zinc coating from its surface. Thereafter, the lead cathode will be immune to zinc plating on its surface in an electrolytic galvanizing operation.

In a preferred embodiment the initial coating of zinc will be removed from the cathode by chemical means. This is accomplished by shutting off the current for a sufficient period of time to allow the pickling action of the free sulfuric acid in the bath to dissolve the coated zinc into solution.

The reasons for this phenomenon are not entirely understood but the end result is clear—when treated according to the method described above, the surface of a lead cathode will remain free of zinc coating during its subsequent use in an electrolytic galvanizing operation.

The electrolyte into which the lead cathode will be immersed for producing its nonplating characteristic is preferably formed of a relatively low pH (less than 1) acidic solution, generally containing about 2 to about 10 percent by weight sulfuric acid, preferably about 4 to about 8 percent, and most preferably, about 5 to about 8 percent by weight of such acid. In addition, zinc sulfate will be present in the solution in an amount between about 0.5 lbs./gal. to about 2.5 lbs./gal., preferably about 1.0–1.5 lbs./gal. The temperature of such a bath will be maintained between 120°–180° F., preferably 140°–150°, although this temperature range is required more for the subsequent in situ electrolytic treatment of galvanized steel strip rather than especially for treating the lead cathode to establish its nonplating characteristics. For the latter purpose, especially if the lead cathode is treated in a separate facility, there will be no critical temperature limitation. However, the chemical components of the electrolyte should in any event be maintained approximately within the above values in order to conveniently achieve the required plating and deplating of zinc from the surface of the lead cathode. Also in this regard it is noted that the electrolyte will usually contain an amount of ferric and ferrous ions, the former having somewhat of a catalyzing effect on achieving the nonplating characteristics. A bath content of as little as 1–10 g/L of iron in the form of iron sulfate will achieve this effect. However, when the cathodes are treated in situ, the iron content of the electrolyte bath should be kept as low as possible, since it otherwise interferes with the resistivity and conductivity of the bath, factors which are important to the subsequent electrolytic galvanizing procedure. Preferably, the iron content of the bath will be kept below 50 grams/liter.

When treated as described above, the lead cathode of this invention is particularly useful in the method for producing a metal strip having galvanized coating on one side which is described in U.S. Pat. No. 3,989,604, the disclosures of which is incorporated herein by reference. In that process, a zinc coated metal sheet or strip material is treated so as to remove the zinc coating from one side thereof, while simultaneously depositing on the other side of the material a substantially equal amount of zinc coating. This is achieved by immersing the strip in a zinc ion containing electrolyte solution and between separate cathode means and anode means, the sheet or strip material thus functioning as a bipolar electrode. By utilizing the nonplating cathode of this invention in such an operation, its efficiency is greatly increased since the need for periodic shut-downs to strip coated zinc from the cathode is eliminated.

As a specific example of the method of producing the nonplating cathode of this invention, a lead cathode was immersed in an electrolytic bath maintained at a temperature of about 130° F., including about 1.7 lbs./gal. of zinc sulfate, and about 4 percent by weight sulfuric acid. Current was introduced at 6000 amps for a period of 12 minutes, and then shut off. The zinc coating then formed on the lead cathode was allowed to dissolve into solution for a period of 1 hour, after which the current was reintroduced following the schedule noted below:

a. 1st hour: 4000 AMPS
b. 2nd hour: 6000 AMPS
c. 3rd hour: 8000 AMPS
d. 4th hour: 10000 AMPS
e. 5th hour: 12000 AMPS
f. 6th hour: 14000 AMPS
g. 7th hour: 16000 AMPS
h. 8th hour: 18000 AMPS
i. 9th hour: 20000 AMPS The resulting cathode was utilized in the same electrolytic bath in treating zinc coated steel strip, essentially according to the process described in U.S. Pat. No. 3,989,604, for a period of 6 hours. The tanks containing the electrolyte bath were then drained, disclosing the absence of any zinc coating on the lead cathode.

As used herein, the designation "lead cathode" should be understood to include all forms of lead used in electrolytic processes, including lead alloys.

The above embodiments are to be considered in all respects as illustrative and not restrictive since the invention may be embodied in other specific forms without departing from its spirit or essential characteristics. Therefore, the scope of the invention is indicated by the claims rather than by the foregoing description, and all changes which come within the meaning and range of the equivalents of the claims are intended to be embraced therein.

We claim:

1. A lead cathode intrinsically having a surface which is immune to plating zinc thereon when immersed in an electrolytic galvanizing bath.

* * * * *